US012275116B2

(12) United States Patent
Gadinski et al.

(10) Patent No.: US 12,275,116 B2
(45) Date of Patent: Apr. 15, 2025

(54) CMP POLISHING PAD WITH WINDOW HAVING TRANSPARENCY AT LOW WAVELENGTHS AND MATERIAL USEFUL IN SUCH WINDOW

(71) Applicant: Rohm and Haas Electronic Materials CMP Holdings, Inc., Newark, DE (US)

(72) Inventors: Matthew R. Gadinski, Newark, DE (US); Mauricio E. Guzman, Bear, DE (US)

(73) Assignee: Rohm and Haas Electronic Materials CMP Holdings, Inc., Newark, DE (US)

( * ) Notice: Subject to any disclaimer, the term of this patent is extended or adjusted under 35 U.S.C. 154(b) by 601 days.

(21) Appl. No.: 17/137,074

(22) Filed: Dec. 29, 2020

(65) Prior Publication Data

US 2022/0203495 A1 Jun. 30, 2022

(51) Int. Cl.

| | |
|---|---|
| ***B24B 37/20*** | (2012.01) |
| ***B24B 37/24*** | (2012.01) |
| ***B24D 3/28*** | (2006.01) |
| ***B24D 3/30*** | (2006.01) |
| ***B24D 3/32*** | (2006.01) |
| *B24B 37/26* | (2012.01) |
| *B24B 49/12* | (2006.01) |

(52) U.S. Cl.

CPC ..... *B24B 37/205* (2013.01); *B24B 37/24* (2013.01); *B24D 3/28* (2013.01); *B24D 3/30* (2013.01); *B24D 3/32* (2013.01); *B24B 37/26* (2013.01); *B24B 49/12* (2013.01)

(58) Field of Classification Search

CPC ..... B24B 37/205; B24B 37/24; B24B 37/26; B24B 49/12; B24B 37/005; B24B 37/22; B24B 37/20; B24D 3/28; B24D 3/30; B24D 3/32; H01L 21/30625; H01L 21/67092

See application file for complete search history.

(56) References Cited

U.S. PATENT DOCUMENTS

| | | | |
|---|---|---|---|
| 5,605,760 | A | 2/1997 | Roberts |
| 6,832,947 | B2 | 12/2004 | Manning |
| 7,018,581 | B2 | 3/2006 | David et al. |
| 7,258,602 | B2 | 8/2007 | Shih et al. |
| 7,429,207 | B2 | 9/2008 | Swedek et al. |
| 7,621,798 | B1 | 11/2009 | Bennett et al. |

(Continued)

FOREIGN PATENT DOCUMENTS

| | | |
|---|---|---|
| JP | 2006021290 | 1/2006 |

*Primary Examiner* — Pegah Parvini
*Assistant Examiner* — Marites A Guino-O Uzzle
(74) *Attorney, Agent, or Firm* — Blake T. Biederman

(57) ABSTRACT

The polishing pad is useful in chemical mechanical polishing. The polishing pad includes a polishing portion having a top polishing surface and a polishing material. There is an opening through the polishing pad and a transparent window within the opening. The transparent window is secured to the polishing pad. The window includes a polyurethane composition formed by reacting, in the presence of a hard segment inhibitor for reducing size of hard segment domains, a polymeric polyol, a polyisocyanate and a curing agent. The curing agent includes three or more hydroxyl groups forming hard segments and the polyurethane composition is an amorphous mixture of hard segments in a soft segments matrix and is free of carbon-carbon double bonds.

10 Claims, 3 Drawing Sheets

(56) References Cited

U.S. PATENT DOCUMENTS

| | | | | |
|---|---|---|---|---|
| 7,762,870 | B2 * | 7/2010 | Ono | B24D 11/001 451/526 |
| 8,257,545 | B2 | 9/2012 | Loyack et al. | |
| 8,475,228 | B2 | 7/2013 | Benvegnu et al. | |
| 9,475,168 | B2 | 10/2016 | Qian et al. | |
| 10,293,456 | B2 * | 5/2019 | Chiou | B24B 37/205 |
| 2006/0291530 | A1 | 12/2006 | Tregub et al. | |

* cited by examiner

CMP POLISHING PAD WITH WINDOW HAVING TRANSPARENCY AT LOW WAVELENGTHS AND MATERIAL USEFUL IN SUCH WINDOW

FIELD OF THE INVENTION

The present invention relates generally to the field of polishing pads for chemical mechanical polishing of substrates such as magnetic, optical and semiconductor substrates, including front end of line (FEOL) or back end of line (BEOL) processing of memory and logic integrated circuits, where the polishing pad has a window to facilitate end point detection. The invention also relates to materials useful in such windows.

BACKGROUND

In the fabrication of integrated circuits and other electronic devices, multiple layers of conducting, semiconducting and dielectric materials are deposited onto and partially or selectively removed from a surface of a semiconductor wafer. Thin layers of conducting, semiconducting and dielectric materials may be deposited using a number of deposition techniques. Common deposition techniques in modern wafer processing include physical vapor deposition (PVD), also known as sputtering, chemical vapor deposition (CVD), plasma-enhanced chemical vapor deposition (PECVD) and electrochemical deposition (ECD), among others. Common removal techniques include wet and dry etching; isotropic and anisotropic etching, among others.

As layers of materials are sequentially deposited and removed, the topography (i.e. uppermost surface) of the wafer becomes non-uniform or non-planar. Because subsequent semiconductor processing (e.g., photolithography, metallization, etc.) requires the wafer to have a flat surface, the wafer needs to be planarized. Planarization is useful for removing undesired surface topography and surface defects, such as rough surfaces, agglomerated materials, crystal lattice damage, scratches and contaminated layers or materials. In addition, in damascene processes a material is deposited to fill recessed areas created by patterned etching of trenches and vias etc. But the filling step can be imprecise, and overfilling is preferable to under filling of the recesses. Thus, material outside the recesses needs to be removed.

Chemical mechanical planarization, or chemical mechanical polishing (CMP), is a common technique used to planarize or polish workpieces such as semiconductor wafers and to remove excess material in damascene processes, front end of line (FEOL) processes or back end of line (BEOL) processes. In conventional CMP, a wafer carrier, or polishing head, is mounted on a carrier assembly. The polishing head holds the wafer and positions the wafer in contact with a polishing surface of a polishing pad that is mounted on a table or platen within a CMP apparatus. The carrier assembly provides a controllable pressure between the wafer and polishing pad. Simultaneously, a slurry or other polishing medium is dispensed onto the polishing pad and is drawn into the gap between the wafer and polishing layer. To effect polishing, the polishing pad and wafer typically rotate relative to one another. As the polishing pad rotates beneath the wafer, the wafer traverses a typically annular polishing track, or polishing region, wherein the wafer's surface directly confronts the polishing layer. The wafer surface is polished and made planar by chemical and mechanical action of the polishing surface and polishing medium (e.g., slurry) on the surface.

Precise control of various aspects (e.g. the thickness of layers) on the substrate being polished can be desirable. Thus, various methods have been proposed to detect when polishing is completed to the desired level. Since polishing pads are often made of opaque materials a transparent window has been inserted in the polishing pad. This enables an optical detection system where a source directs electromagnetic radiation (e.g. light of desired wavelength) through the transparent window toward the substrate and a sensor detects the electromagnetic radiation (e.g. light) reflected from the substrate and passing back through the window. Various window designs have been proposed. See e.g. U.S. Pat. Nos. 7,258,602; 8,475,228; 7,429,207; 9,475,168; 7,621,798; and 5,605,760 and JP2006021290.

Some endpoint detection schemes have used single wavelengths for detection (e.g. wavelengths around 600 nm). However, scanning laser interferometers operating at multiple wavelength ranges or systems having a broad-spectrum light source have also been used. These can be advantageous in that they can yield additional data (e.g. about thickness of layers on the substrate). The wavelengths of that can be used then can be from 200 to 800 nm. As film thicknesses are reduced over time due to semiconductor scaling, increased measurement accuracy of much thinner films is required. Measurement accuracy improvements require use of lower wavelengths for the interferometry. This has led to a need for window materials with increased transmission in the ultraviolet region (specifically in the region between 250-380 nm). Many current windows do not have good transmission across the full range of these wavelengths. While U.S. Pat. No. 10,293,456 discloses compositions that have UV cutoff at lower than 325 nm, these compositions can have undesirable mechanical properties in certain applications and do not have acceptable transmittance at 250 nm.

SUMMARY OF THE INVENTION

Disclosed herein is a polishing pad useful in chemical mechanical polishing comprising a polishing portion having a top polishing surface and a polishing material an opening through the polishing pad, and a transparent window within the opening in the polishing pad, the transparent window being secured to the polishing pad wherein the window comprises a polyurethane composition formed by reacting, in the presence of a hard segment inhibitor for reducing size of hard segment domains, a polymeric polyol, a polyisocyanate, and a curing agent comprising three or more hydroxyl groups forming hard segments and wherein the polyurethane composition is an amorphous mixture of hard segments in a soft segments matrix and the polyurethane composition is free of carbon-carbon double bonds.

As used herein, "free of" means there is less than 1, less than 0.5, less than 0.1, less than 0.05 mole, less than 0.01 mole % of the recited element based on total moles of the component. For example, the polyurethane can have less than 1, less than 0.5, less than 0.1, less than 0.05 or less than 0.01 mole percent of carbon-carbon unsaturation (e.g. carbon-carbon double bond and carbon-carbon triple bond) based on moles of polyurethane.

DETAILED DESCRIPTION OF THE INVENTION

Figure 1:
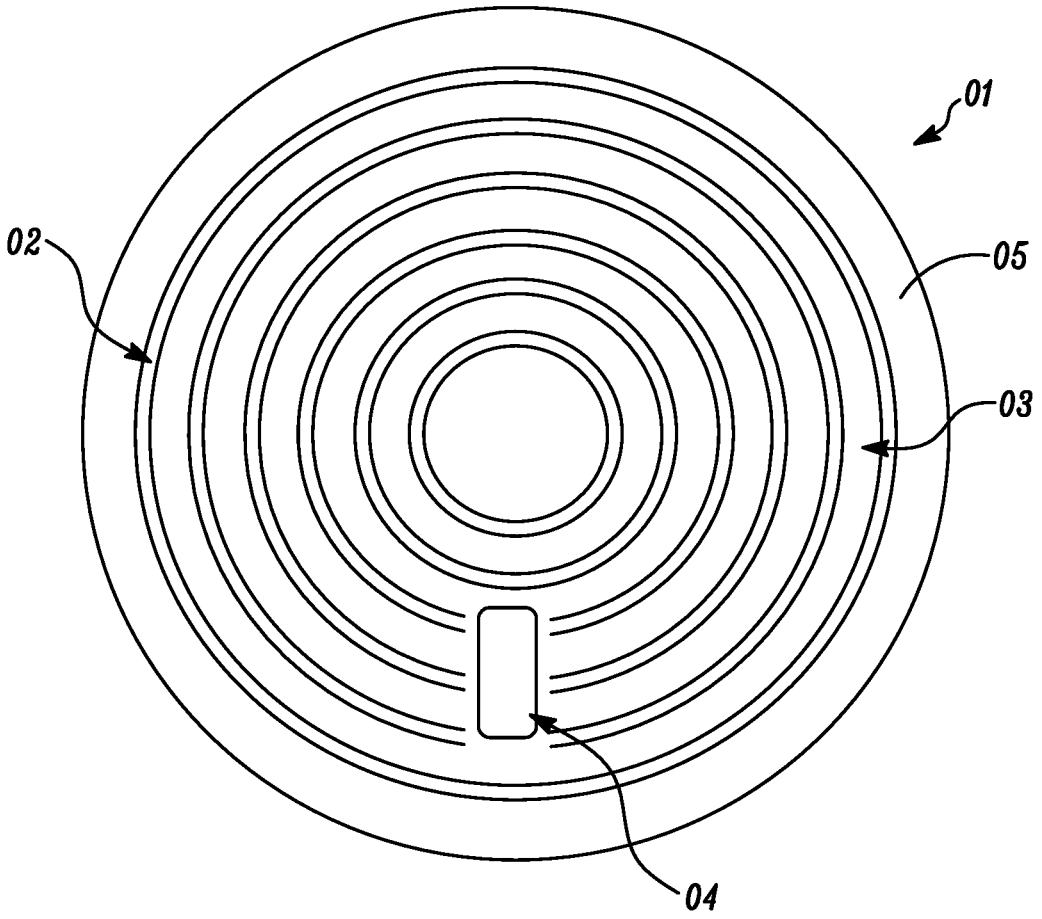
FIG. 1 is a plan view of a chemical mechanical polishing pad including a window.

The inventors have discovered that addition of a hard segment inhibitor for reducing size of hard segment domains when forming polyurethane windows. It has been discovered that limiting size of the hard segment domains in amorphous polyurethane compositions improves light transmissivity. These amorphous polyurethane compositions consist of a mixture of hard segments in a soft segment matrix. In the absence of the inhibitor, the hard segments can form clusters that interfere with light transmission. Specifically, the windows disclosed herein can have one or more of the following characteristics: good light transmissivity at 250 nm, good transmissivity at 280 nm, preferably 250 nm, combined with a low modulus. Specifically, the pads disclosed herein can enable use of broad-spectrum light source detectors in end point detection during chemical mechanical polishing. Also, the pads disclosed herein can avoid problems (e.g. defects and scratching) that can arise if the mechanical properties of the window differ substantially from the mechanical properties of the pad polishing material.

Thus, the polyurethane window material can have good transparency from wavelengths as low as 240, or 250, or 250, or 270 or 280 nm up to 800, or up to 700 or up to 650 or up to 600 nm. For example, the window comprising the polyurethane composition can have a "double pass transmittance" of at least 1%, at least 2%, at least 3% or at least 5% at a wavelength of 250 nm. As another example, the window comprising the polyurethane composition can have a "double pass transmittance" of at least 0.75%, at least 1%, at least 2%, at least 3% or at least 5% at a wavelength of 240 nm. As another example, the window comprising the polyurethane composition can have a double pass transmittance of at least 1%, at least 2%, at least 3% or at least 5% at a wavelength of 280 nm (or at 260 nm or at 250 nm) and either or both of (i) a Shore D Hardness of no more than 75, or no more than 70, or no more than 65, or no more than 60 (e.g. according to ASTM D2240-15 (2015)) and (ii) a tensile modulus of from 3000 or from 5000 or from 10,0000, or from 20,000, or from 25,000 up to 70,000, or up to 60,000, or up to 50,000 or up to 45,000 pounds per square inch (psi) (or from about 20.7, or from about 34.4, or from about 68.9, or from about 138, or from about 172 up to about 483, or up to about 414, or up to about 345 or up to 310 megapascals (MPa)) according to ASTM D412-06a (2013).

To reduce defects, the tensile modulus of the polyurethane window can be such that it is similar to the tensile modulus of the polishing material. For example, the tensile modulus of the window material can be from 50% or from 75% up to 150% or up to 130% the value of the tensile modulus of the polishing material. Advantageously, the modulus is 75 to 130% of the tensile strength of the polishing material.

As used herein double pass transmittance is a normalized value of the light that passes through the window from the light source, reflects off a silicon substrate, passes back through the window and then is detected. The normalized value can be calculated using the following equation: $DPT=(IW_{Si}-IW_D)\div(IA_{Si}-IA_D)$ where $IW_{Si}$ is a measurement of the intensity of light that passes through the window from the point of origin and reflects off the surface of a silicon blanket wafer placed against a second face of the window back through the window to the detector; wherein $IW_D$ is a measurement of the intensity of light that passes from the point of origin through the window and reflects off the surface of a black body and back through the window to the detector; wherein $IA_{Si}$ is a measurement of the intensity of light that passes from the point of origin through a thickness of air equivalent to the thickness, Tw, of the endpoint detection window, reflects off the surface of a silicon blanket wafer and reflects back through the thickness of air to the detector; and, wherein $IA_D$ is a measurement of the intensity of light reflected off a black body through air.

The window material comprises a polyurethane that is free of carbon-carbon double bonds (e.g. particularly, conjugated carbon-carbon double bonds, aromatic groups). Advantageously, the polyurethane is also free carbon-carbon triple bonds. The polyurethane is formed in the presence of a hard segment inhibitor that is free of carbon-carbon double bonds (e.g. aromatic groups), carbon-carbon triple bonds or both. For example, the window material can be the reaction product of a polymeric polyol that is free of carbon-carbon double bonds, carbon-carbon triple bonds or both with and a polyisocyanate that is free of carbon-carbon double bonds, carbon-carbon triple bonds or both. The polyurethane can be cured by use of a curing agent that has a least 3 (e.g. 3 to 5; 3 or 4 or 5) hydroxyl groups and that is free of carbon-carbon double, carbon-carbon triple bonds or both. The use of the curing agent is particularly desired when the polymeric polyol is a diol. The polymeric polyol and the polyisocyanate can be first reacted to form a prepolymer that has isocyanate end groups that then can be reacted with the curing agent. This approach is preferred when a polyalkylene glycol is the polymeric diol. Alternatively, the polymeric polyol, the polyisocyanate, and the curing agent may all be combined and reacted in a single step. The hard segment inhibitor can be present when forming the prepolymer. The hard segment inhibitor, however, must be present when curing the polyurethane composition.

The polymeric polyol can be a polymer having two or more hydroxyl groups and a polymeric backbone that is free of or substantially free of carbon-carbon double bonds, carbon-carbon triple bonds or both. For example, the polymeric polyol can be a polyalkylene glycol (e.g. $HO—[R—O]_n—H$) where R is an aliphatic group of 2, 3, 4, or 5 carbon atoms, R can be independent in each occurrence or each occurrence of R can be the same, and n is an integer of from 2, or from 3, or from 4 up to 100, or up to 80 or up to 60 or up to 40 or up to 30, or up to 25 or up to 20). Specific examples of such polyalkylene glycols include polyethylene glycol, polypropylene glycol, polytetramethylene ether glycol or copolymers of two or more thereof. As another example the polymeric polyol can be a polycarbonate polyol. Such polycarbonate diol can be the reaction product of polyester glycols with alkylene carbonates, for example, polycaprolactone polyol with alkylene carbonate; polyester polycarbonate polyols obtained by reacting ethylene carbonate with a diol or glycol and reacting the resulting reaction mixture with an organic dicarboxylic acid, and polycarbonate polyols obtained by ester exchange reaction of a diol or polyether diol compound with alkylene carbonate. The polymeric polyol can be a diol. The polymeric polyol can be a blend of polymeric polyols of different composition or molecular weight. The number average molecular weight of the blend of polymeric polyols can be at least 300, or at least 400 up to 4000 or up to 3500 or up to 3000 or up to 2500 or up to 2000 or up to 1500. Individual polymeric polyols used in the blend can have molecular weights as low as 200 and up to 6000. The number average molecular weight can be determined by gel permeation chromatography using a polystyrene standard. The number average molecular weight can be calculated by the summation of the products of the mole fraction and molecular weights of all the polyol components. Lower average molecular weights or high amounts of low molecular weight polyols can lead to harder polyurethane. Higher average molecular weights or low amounts of low molecular weight polyols can lead to a polyurethane that is less hard or has a lower modulus.

The polyisocyanate is an isocyanate functional compound having 2 or more isocyanate groups and being free of or substantially free of carbon-carbon double bonds, carbon-carbon triple bonds or both. For example, the polyisocyanate can have 2, 3 or 4 isocyanate functional groups. Di-isocyanates can be used. Examples of such diisocyanates include aliphatic diisocyanates or cycloaliphatic diisocyanates. Examples of cycloaliphatic diisocyanates include 1,4-cyclohexane diisocyanate, 4,4'-dicyclohexylmethane diisocyanate, isophorone diisocyanate, methylene bis-cyclohexyl isocyanate, (4,4'-dicyclohexyl-methane diisocyanate) [note this latter can also be referred to as, 4,4'-methylenebis (cyclohexyl isocyanate) and abbreviated herein as (H12MDI)]. Combinations of more than one aliphatic or cycloaliphatic polyisocyanates can be used.

The curing agent is free of or substantially free or carbon-carbon double bonds, carbon-carbon triple bonds or both, and has functionality for reacting with isocyanate groups. For example, it can be a polyol having 3 or more hydroxyl groups (e.g. 3 or 4 hydroxyl groups). The curing agent can have a molecular weight in the range of from 100 or from 120 up to 4000, or up to 3500, or up to 3000, or up to 2000, or up to 1000, or up to 600, or up to 400, or up to 350. Examples include trimethylol propane (TMP), propoxylated trimethylolpropane having from 1 to 4 propoxy groups, propoxylated glycerol having from 2 to 6 propoxy group, aliphatic amine functional polyether polyols such as Voranol™ 800 from The Dow Chemical Company.

As noted above the polyurethane can be made in single step synthesis or in a multi-step synthesis.

In a multistep synthesis the polymeric polyol (e.g., a polymeric diol) is reacted with a slight stoichiometric excess of polyisocyanate needed to form a prepolymer that is end capped with the isocyanate. For example, with a polymeric diol and a diisocyanate, the mole ratio of diol:diisocyanate is from 1:1 to 1:1.2 or to 1:1.1. The weight % of unreacted isocyanate groups on the prepolymer based on total weight of the prepolymer can be from 5 up to 15 or up to 10 weight %. After forming the prepolymer, the curing agent can be added and reacted. The amount of curing agent can be such that the stoichiometry of unreacted isocyanate groups from the prepolymer composition to reactive functional groups (e.g. hydroxyl) on the cure agent (i.e. the mole ratio reactive functional groups from the curing agent:unreacted isocyanate groups in the prepolymer is from 0.85:1 to 110:1. The weight ratio of the polymeric diol to the curing agent can be from 1.5:1 up to 10:1 or up to 8:1.

The two-step approach was found to provide better transmittance in the final cured polyurethane when the diols were polyalkylene glycols.

Alternatively, a single step reaction can be used by combining a polymeric polyol with the polyisocyanate. Where a polymeric diol and diisocyanate are used a curing agent having at least 3 reactive functional groups (e.g. hydroxyl) is also added. This approach has been found to provide polyurethanes with good transmittance when polycarbonate polyols (particularly polycarbonate diols) are used. For example, from 30 or from 40 up to 60 weight percent of polyisocyanate (e.g. diisocyanate) based on total weight of reactive components (i.e. isocyanate and hydroxyl functional components—for example, polyisocyanate, polymeric polyol, and curing agent) can be combined with the polyol (especially including at least one polyol having 3 or more hydroxyl groups). Thus, the cumulative amount of polyols is from 30, or from 35, or from 40 up to 70, or up to 60, or up to 55 weight percent based on total weight of reactive components. The weight ratio of polymeric polyol to curing agent can be 1.5:1 or 1.6:1 up to 10:1 or up to 8:1 or up to 6:1. The mole ratio of diisocyanate to polymeric diols can be from 1.5:1 or from 1.7:1 or from 2:1 up to 3.5:1 or up to 2:1. A lower ratio can lead to a polyurethane that is less hard and has a lower modulus that can be helpful if the polishing material also has a lower modulus or hardness.

The above polyols, polyisocyanate and curing agents can be reacted in the presence of a catalyst. The catalyst can be free of carbon-carbon double bonds (e.g. free of aromatic groups), carbon-carbon triple bonds or both. Examples of suitable catalysts include tin containing catalyst (e.g. in an amount of from 0.00001 to 0.1 wt. %), an aliphatic amine catalyst (e.g. in an amount of from 0.01 to 1 wt. %), or a bismuth containing catalyst (e.g. in an amount of from 0.00001 to 0.1 wt. %, all weight percents based on the total solids weight of the reaction mixture.

The hard segment inhibitor is present in an amount of at least 0.5, or at least 1, or at least 1.5, or at least 2 weight percent based on total weight of the window material. The hard segment inhibitor can be present in an amount of up to 10, or up to 7, or up to 5 weight percent based on total weight of the window material. The hard segment inhibitor can be added during preparation of the prepolymer or during reaction of the curing agent with the prepolymer in the two-step reaction process. The hard segment inhibitor is added before or during reaction in the one-step reaction process. The hard segment inhibitor can be an anionic or non-ionic additive soluble in liquid polyurethane. For example, the hard segment inhibitor can be a sulfate, sulfonate, phosphate or carboxylate of an alkyl ether or of a polyalkylene oxide (e.g. polyethylene oxide) or can be a monoalkyl ether of a polyalkylene oxide, an ethoxylate, a fatty alcohol ethoxylate, a fatty acid ethoxylate. The hard segment inhibitor is free of carbon-carbon double bonds, carbon-carbon triple bonds or both. A specific example is phosphate ester such as Merpol™ A hard segment inhibitor.

The polyurethane composition could also be used for purposes other than as a transparent window. For example, the polyurethane composition could be used in a polishing material for chemical mechanical polishing pads. In that instance, the composition may also include such additives as are commonly found in such polishing materials. For examples, hollow microspheres in an amount of about 1-5 or 1-4% by weight based on total weight of polishing material, abrasive particles, or other additives can be used since transparency would not be a critical property in such usages.

The polishing portion can comprise any composition commonly used in polishing pads. The polishing portion can comprise thermoplastic or thermoset polymers. The polishing portion can be a composite such as composites include polymers filled with carbon or inorganic fillers and fibrous mats of, for example, glass or carbon fibers impregnated with a polymer. The polishing portion can have voids. Examples of polymers that can be used in the polishing portion in polymeric materials that can be used in the base pad or polishing portion include polycarbonates, polysulfones, nylons, epoxy resins, polyethers, polyesters, polystyrenes, acrylic polymers, polymethyl methacrylates, polyvinylchlorides, polyvinyl fluorides, polyethylenes, polypropylenes, polybutadienes, polyethylene imines, polyurethanes, polyether sulfones, polyamides, polyether imides, polyketones, epoxies, silicones, copolymers thereof (such as, polyether-polyester copolymers), and combinations or blends thereof. The polymer can be a polyurethane.

The polishing portion can have Young's modulus of according to ASTM D412-16 of at least 2, at least 2.5, at least 5, at least 10, or at least 50 MPa up to 900, up to 700, up to 600, up to 500, up to 400, up to 300, or up to 200 MPa. The polishing portion can be opaque to the signal being used for endpoint detection.

A base pad (also referred to as sublayer or base layer) can be used under the polishing portion. The base pad can be a single layer or can comprise more than one layer. The top surface of the base pad can define a plane, in the x-y Cartesian coordinates. For example, the polishing portion may be attached to a subpad via mechanical fasteners or by an adhesive. The base layer can have a thickness of at least 0.5 or at least 1 mm. The base layer can have a thickness of no more than 5, no more than 3, or no more than 2 mm.

The base pad or base layer may comprise any material known for use as base layers for polishing pads. For example, it can comprise a polymer, a composite of a polymeric material with other materials, ceramic, glass, metal, stone or wood. Polymers and polymer composites can be used as the base pad, particularly for the top layer if there is more than one layer, due to compatibility with the material that can form the polishing portion. Examples of such composites include polymers filled with carbon or inorganic fillers and fibrous mats of, for example, glass or carbon fibers impregnated with a polymer. The base of the pad can be made of a material having one or more of the following properties: a Young's modulus as determined, for example, by ASTMD412-16 in the range of at least 2, at least 2.5, at least 5, at least 10, or at least 50 MPa up to 900, up to 700, up to 600, up to 500, up to 400, up to 300, or up to 200 MPa; a Poisson's ratio as determined, for example, by ASTM E132015 of at least 0.05, at least 0.08, or at least 0.1 up to 0.6 or up to 0.5; a density of at least 0.4 or at least 0.5 up to 1.7, up to 1.5, or up to 1.3 grams per cubic centimeter ($g/cm^3$).

Examples of such polymeric materials that can be used in the base pad or polishing portion include polycarbonates, polysulfones, nylons, epoxy resins, polyethers, polyesters, polystyrenes, acrylic polymers, polymethyl methacrylates, polyvinylchlorides, polyvinyl fluorides, polyethylenes, polypropylenes, polybutadienes, polyethylene imines, polyurethanes, polyether sulfones, polyamides, polyether imides, polyketones, epoxies, silicones, copolymers thereof (such as, polyether-polyester copolymers), and combinations or blends thereof.

The polymer can be a polyurethane. The polyurethane can be used alone or can be a matrix for carbon or inorganic fillers and fibrous mats of, for example, glass or carbon fibers, For purposes of this specification, "polyurethanes" are products derived from difunctional or polyfunctional isocyanates, e.g. polyetherureas, polyisocyanurates, polyurethanes, polyureas, polyurethaneureas, copolymers thereof and mixtures thereof. The CMP polishing pads in accordance may be made by methods comprising: providing the isocyanate terminated urethane prepolymer; providing separately the curative component; and combining the isocyanate terminated urethane prepolymer and the curative component to form a combination, then allowing the combination to react to form a product. It is possible to form the base pad or base layer by skiving a cast polyurethane cake to a desired thickness. Optionally, it is possible to use either thermoplastic or thermoset polymers. The polymer can be a crosslinked thermoset polymer.

When a polyurethane is used in the base pad or the polishing layer it can be the reaction product of a polyfunctional isocyanate and a polyol. For example, a polyisocyanate terminated urethane prepolymer can be used. The polyfunctional isocyanate used in the formation of the polishing layer of the chemical mechanical polishing pad of the present invention can be selected from the group consisting of an aliphatic polyfunctional isocyanate, an aromatic polyfunctional isocyanate and a mixture thereof. For example, the polyfunctional isocyanate used in the formation of the polishing layer of the chemical mechanical polishing pad of the present invention can be a diisocyanate selected from the group consisting of 2,4-toluene diisocyanate; 2,6-toluene diisocyanate; 4,4'-diphenylmethane diisocyanate; naphthalene-1,5-diisocyanate; tolidine diisocyanate; para-phenylene diisocyanate; xylylene diisocyanate; isophorone diisocyanate; hexamethylene diisocyanate; 4,4'-dicyclohexylmethane diisocyanate; cyclohexanediisocyanate; and, mixtures thereof. The polyfunctional isocyanate can be an isocyanate terminated urethane prepolymer formed by the reaction of a diisocyanate with a prepolymer polyol. The isocyanate-terminated urethane prepolymer can have 2 to 12 wt %, 2 to 10 wt %, 4-8 wt % or 5 to 7 wt % unreacted isocyanate (NCO) groups. The prepolymer polyol used to form the polyfunctional isocyanate terminated urethane prepolymer can be selected from the group consisting of diols, polyols, polyol diols, copolymers thereof and mixtures thereof. For example, the prepolymer polyol can be selected from the group consisting of polyether polyols (e.g., poly(oxytetramethylene)glycol, poly(oxypropylene)glycol and mixtures thereof); polycarbonate polyols; polyester polyols; polycaprolactone polyols; mixtures thereof and, mixtures thereof with one or more low molecular weight polyols selected from the group consisting of ethylene glycol; 1,2-propylene glycol; 1,3-propylene glycol; 1,2-butanediol; 1,3-butanediol; 2-methyl-1,3-propanediol; 1,4-butanediol; neopentyl glycol; 1,5-pentanediol; 3-methyl-1,5-pentanediol; 1,6-hexanediol; diethylene glycol; dipropylene glycol; and, tripropylene glycol. For example, the prepolymer polyol can be selected from the group consisting of polytetramethylene ether glycol (PTMEG); ester based polyols (such as ethylene adipates, butylene adipates); polypropylene ether glycols (PPG); polycaprolactone polyols; copolymers thereof; and, mixtures thereof. For example, the prepolymer polyol can be selected from the group consisting of PTMEG and PPG. When the prepolymer polyol is PTMEG, the isocyanate terminated urethane prepolymer can have an unreacted isocyanate (NCO) concentration of 2 to 10 wt % (more preferably of 4 to 8 wt %; most preferably 6 to 7 wt %). Examples of commercially available PTMEG based isocyanate terminated urethane prepolymers include Imuthane® prepolymers (available from COIM USA, Inc., such as, PET-80A, PET-85A, PET-90A, PET-93A, PET-95A, PET-60D, PET-70D, PET-75D); Adiprene® prepolymers (available from Chemtura, such as, LF 800A, LF 900A, LF 910A, LF 930A, LF 931A, LF 939A, LF 950A, LF 952A, LF 600D, LF 601D, LF 650D, LF 667, LF 700D, LF750D, LF751D, LF752D, LF753D and L325); Andur® prepolymers (available from Anderson Development Company, such as, 70APLF, 80APLF, 85APLF, 90APLF, 95APLF, 60DPLF, 70APLF, 75APLF). When the prepolymer polyol is PPG, the isocyanate terminated urethane prepolymer can have an unreacted isocyanate (NCO) concentration of 3 to 9 wt % (more preferably 4 to 8 wt %, most preferably 5 to 6 wt %). Examples of commercially available PPG based isocyanate terminated urethane prepolymers include Imuthane® prepolymers (available from COIM USA, Inc., such as, PPT-80A, PPT-90A, PPT-95A, PPT-65D, PPT-75D); Adiprene® prepolymers (available from Chemtura, such as, LFG 963A, LFG 964A, LFG 740D); and, Andur® prepolymers (available from Anderson Development Company, such as, 8000APLF, 9500APLF, 6500DPLF, 7501DPLF). The isocyanate terminated urethane prepolymer can be a low free isocyanate terminated urethane prepolymer having less than 0.1 wt % free toluene diisocyanate (TDI) monomer content. Non-TDI based isocyanate terminated urethane prepolymers can also be used. For example, isocyanate terminated urethane prepolymers include those formed by the reaction of 4,4'-diphenylmethane diisocyanate (MDI) and polyols such as polytetramethylene glycol (PTMEG) with optional diols such as 1,4-butanediol (BDO) are acceptable. When such isocyanate terminated urethane prepolymers are used, the unreacted isocyanate (NCO) concentration is preferably 4 to 10 wt % (more preferably 4 to 10 wt %, most preferably 5 to 10 wt %). Examples of commercially available isocyanate terminated urethane prepolymers in this category include Imuthane® prepolymers (available from COIM USA, Inc. such as 27-85A, 27-90A, 27-95A); Andur® prepolymers (available from Anderson Development Company, such as, IE75AP, IE80AP, IE 85AP, IE90AP, IE95AP, IE98AP); and, Vibrathane® prepolymers (available from Chemtura, such as, B625, B635, B821).

Production of the final pad containing the windows as disclosed herein can be prepared via a number of techniques including, but not limited to, preparation of a discrete window having the desired pattern of recesses in the upper window surface, followed by insertion into an opening in the upper pad layer that is aligned with the aperture in the subpad layer (a so-called insertion window). A sealant or adhesive can be used to secure the window in the polishing pad. Examples of such materials include pressure sensitive adhesives, acrylics, polyurethanes, and cyanoacrylates. Alternatively, a block of the window material can be machined to the cross-sectional dimensions of the final window. This block is placed in a mold and the top pad layer material is cast around it. The resulting composite cylinder can then be sliced into sheets of the desired thickness, after which the texture of the upper window surface is produced. As yet another alternative, the pad with window can be formed by casting the polishing portion around the finished window via techniques such as injection molding or compression molding to produce a single net shaped top pad layer, with the composite window cast in place.

FIG. 1 shows a pad 01 with window 04. There can be optional grooves 02 in the planar surface 03 of the polishing portion 05. The polishing portion can be a separate layer on a subpad or base pad (not shown). Concentric grooves are shown, but other groove patterns can be used, such as radial grooves or cross-hatch grooves or combinations of groove patterns. Alternatively, the polishing portion of the pad may have other texture. The polishing portion of the pad can be porous or be formed from lattices of materials or have other patterns thereon.

The pad can have a dimension (e.g. diameter or length/width) of at least 10, at least 20, at least 30, at least 40, or at least 50 centimeters (cm) up to 100, up to 90, or up to 80 cm. The thickness of the pad can be 1 mm up to 4 mm or up to 3 mm. If the pad includes a top polishing portion on a sub pad, the thickness of the window can be more than the thickness of the top polishing portion. The thickness of the polishing portion can be at least 1, or at least 1.1 mm up to 3, or up to 2.5 mm. The thickness of the window can be at least 0.5, at least 0.75, or at least 1 mm, up to 3, up to 2.9, up to 2.5 mm. The window can have dimensions of at least 0.5 or at least 1 cm up to 3, or up to 2.5, up to 2, or up to 1 cm (in length and width or in diameter if a circular window).

Method

The polishing pads as disclosed here can be used to polish substrates. For example, the polishing method can include providing a substrate to be polished and then polishing using the pad disclosed herein with the protrusions in contact with the substrate to be polished. The substrate can be any substrate where polishing or planarization is desired. Examples of such substrates include magnetic, optical and semiconductor substrates. The method made be part front end of line or back end of line processing for integrated circuits. For example, the process can be used to remove undesired surface topography and surface defects, such as rough surfaces, agglomerated materials, crystal lattice damage, scratches and contaminated layers or materials. In addition, in damascene processes a material is deposited to fill recessed areas created by one or more steps of photolithography, patterned etching, and metallization. Certain steps can be imprecise—e.g. there can be overfilling of recesses. The method disclosed here can be used to remove material outside the recesses. The process can be chemical mechanical planarization or chemical mechanical polishing both of which can be referred to as CMP. A carrier can hold the substrate to be polished—e.g. a semiconductor wafer (with or without layers formed by lithography and metallization) in contact with the polishing elements of the polishing pad. A slurry or other polishing medium can be dispensed into a gap between the substrate and the polishing pad. The polishing pad and substrate are moved relative to one another—e.g. rotated. The polishing pad is typically located below the substrate to be polished. The polishing pad can rotate. The substrate to be polished can also be moved—e.g. on a polishing track such as an annular shape. The relative movement causes the polishing pad to approach and contact the surface of the substrate.

For example, the method can comprise: providing a chemical mechanical polishing apparatus having a platen or carrier assembly; providing at least one substrate to be polished; providing a chemical mechanical polishing pad as disclosed herein; installing onto the platen the chemical mechanical polishing pad; optionally, providing a polishing medium (e.g. slurry or non-abrasive containing reactive liquid composition) at an interface between a polishing portion of the chemical mechanical polishing pad and the substrate; creating dynamic contact between the polishing portion of the polishing pad and the substrate, wherein at least some material is removed from the substrate. The carrier assembly carrier assembly can provide a controllable pressure between the substrate being polished (e.g. wafer) and the polishing pad. The polishing medium a polishing medium can be dispensed onto the polishing pad and drawn into the gap between the wafer and polishing layer. The polishing medium can comprise water, a pH adjusting agent, and optionally one or more of, but not limited to, the following: an abrasive particle, an oxidizing agent, an inhibitor, a biocide, soluble polymers, and salts. The abrasive particle can be an oxide, metal, ceramic, or other suitably hard material. Typical abrasive particles are colloidal silica, fumed silica, ceria, and alumina. The polishing pad and substrate can rotate relative to one another. As the polishing pad rotates beneath the substrate, the substrate can sweep out a typically annular polishing track, or polishing region, wherein the wafer's surface directly confronts the polishing portion of the polishing pad. The wafer surface is polished and made planar by chemical and mechanical action of the polishing layer and polishing medium on the surface. Optionally, the polishing surface of the polishing pad can be conditioned with an abrasive conditioner before beginning polishing. The method of the present invention, the chemical mechanical polishing apparatus provided further includes a signal source (e.g. a light source) and a signal detector (e.g. a photosensor (preferably a multisensor spectrograph). The method can therefore comprise: determining a polishing endpoint by transmitting a signal (e.g. light from the light source) through the window and analyzing the signal (e.g. light) reflected off the surface of the substrate back through the endpoint detection window incident upon the sensor (e.g. photosensor). The substrate can have a metal or metallized surface, such as one containing copper or tungsten. The substrate can be a magnetic substrate, an optical substrate and a semiconductor substrate.

EXAMPLES

Materials

Polymeric Polyols:

PTMEG 250 (polytetramethylene glycol, Molecular weight of 250) from Sigma Aldrich PTMEG xx (polytetramethylene glycol other molecular weights) are Terathane™ from Invista.

Desmophen™ XP2716 (aliphatic polycarbonate diol, MW about 650) from Covestro AG.

Polyisocyanate: Desmodur™ W (H12MDI) liquid cycloaliphatic diisocyanate from Covestro.

Hard segment inhibitor: Merpol™ A phosphate alcohol from Stepan Company.

Catalyst: Dabco LV33 from Evonik.

Curing Agents:

Voranol™ 800 aliphatic amine initiated polyol with hydroxyl functionality of 4 and hydroxyl weight of 800 from Dow Chemical Company TMP (trimethyolpropane) from Sigma Aldrich.

Example 1. Two-Step Process for Formation of Polyurethane Composition

PTMEGs are heated to 65° C. before using. The heated PTMEGs and catalyst are added to a mixing cup and vortex mixed at 1000 RPM for 30 seconds. H12MDI is then added to the mixing cup and vortex mixed again for 30 seconds. The mixing cup is then placed in an oven at 80° C. for 4 hours to complete the isocyanate reaction with the diols. Before using the prepolymer it is degassed via vacuum chamber. To the degassed prepolymer Voranol™ 800 polyol is preheated to 65° C. An amount of Voranol™ 800 polyol to have a mole ratio of unreacted NCO from prepolymer composition:hydroxyl groups of Voranol™ 800 polyol of 1.05:1 is added and vortex mixed. The reaction mixture is degassed again before adding to the mold. The samples in the mold are then heated in oven to 80° C. for 8 hours followed at an additional 4 hours of heating at 110° C.

For compositions on the invention, the Merpol™ A hard segment inhibitor is added prior to curing in the amounts shown in Table 1. The polyurethane formulations are shown in Table 1.

TABLE 1

| | PTMEG composition (mol % of polymeric polyol based on total mole of all PTMEGs) | | | | Wt % unreacted NCO groups in prepolymer based on total | Amount of Merpol ™ A hard segment inhibitor (weight % based on total weight of |
|---|---|---|---|---|---|---|
| Sample ID | PTMEG 250 | PTMEG 650 | PTMEG 1000 | PTMEG 2000 | weight of prepolymer | polyurethane composition) |
| UV1 | 62 | 18.3 | 13.3 | 6.4 | 8.5 | — |
| UV2 | 50 | — | — | 50 | 6 | — |
| UV3 | 75 | — | — | 25 | 7.5 | — |
| UV4 | 90 | — | — | 10 | 9.3 | — |
| UV1-M.5 | 62 | 18.3 | 13.3 | 6.4 | 8.5 | 0.5 |
| UV1-M1 | 62 | 18.3 | 13.3 | 6.4 | 8.5 | 1 |
| UV1-M1.5 | 62 | 18.3 | 13.3 | 6.4 | 8.5 | 1.5 |
| UV1-M2 | 62 | 18.3 | 13.3 | 6.4 | 8.5 | 2 |
| UV1-M5 | 62 | 18.3 | 13.3 | 6.4 | 8.5 | 5 |

Example 2. Window Material Characterization

The various polyurethanes are characterized for various properties as follows:

Hardness

Six 1.5"×1.5" samples are cut from each plaque. Four samples are used for density testing, while all six samples are used for hardness testing. Sample length and width are measured for dimensional density using Fisher Vernier calipers. A Fowler micrometer is used to measure sample thickness. Hardness is measured on a Rex/Hybrid hardness tester with a D probe. The six samples are stacked and shuffled for each hardness measurement such that every sample is probed once.

Tensile Testing

Analysis is performed in accordance with ASTM D412-06a "Standard Test Methods for Vulcanized Rubber and Thermoplastic Elastomers-Tension." Samples are die cut to dogbone-type C dimensions. An Alliance RT/5 materials testing system (MTS) running TestWorks 4 software is used. Data was collected at 500 Hz with sample elongation at 20 in/min. (50.8 cm/min.). Pneumatic grip separation is set to 2.5 in. (6.4 cm), with nominal gauge length of 1.5 in. (3.8 cm).

DMA

Samples are cut with a 6.5 mm width and 36 mm length. An ARES G2 tensional rheometer or a Rheometric Scientific RDA3 (both from TA instruments) are used in accordance with ASTM D5279-13 "Standard Test Method for Plastics: Dynamic Mechanical Properties: In Torsion." The gap separation is 20 mm. Instrument analysis parameters are set at 100 g of preload 0.2% strain, oscillation speed of 10 rads/sec, and with a temperature ramp rate of 3° C./min from −100° C. to 150° C. This enables evaluation of Tg.

Transmission Testing

The sample for transmission testing are cut into 2 in. by 2 in. (6.4 cm by 6.4 cm) squares from plaques. From the cut squares a 0.5" circle is punched. The transmission was tested using the punched circle with the empty hole left in the square used as an air gap reference. The transmission is tested with an Ocean Optics DH-2000 light source (which includes emitter, detector and decoder). The method is as discussed above for double pass transmittance.

The results for the Samples from Table 1 from hardness and tensile testing are shown in Table 2.

TABLE 2

| Sample | Hardness (shore D) | G' @ 30° C. (MPa) | Tensile Strength (psi)/MPa | Elongation (%) | Modulus (psi)/MPa | Approximate Tg (° C.) |
|---|---|---|---|---|---|---|
| UV1 | 52.9 | 107 | 2810/19.4 | 161 | 33661/232 | 51 |
| UV2 | 31.1 | 8.74 | 1386/9.6 | 316 | 1838/12.7 | 30 |
| UV3 | 51.4 | 120 | 2144/14.8 | 131 | 30980/214 | 60 |
| UV4 | 67.5 | 358 | 5044/34.8 | 51 | 76715/529 | 68 |
| UV1-M5 | 56 | 126 | 3744/25.8 | 193 | 37105/256 | 51 |

DMA testing demonstrated that Tg shifted to higher values as with increasing amounts of the low molecular weight PTMEG.

Figure 2:
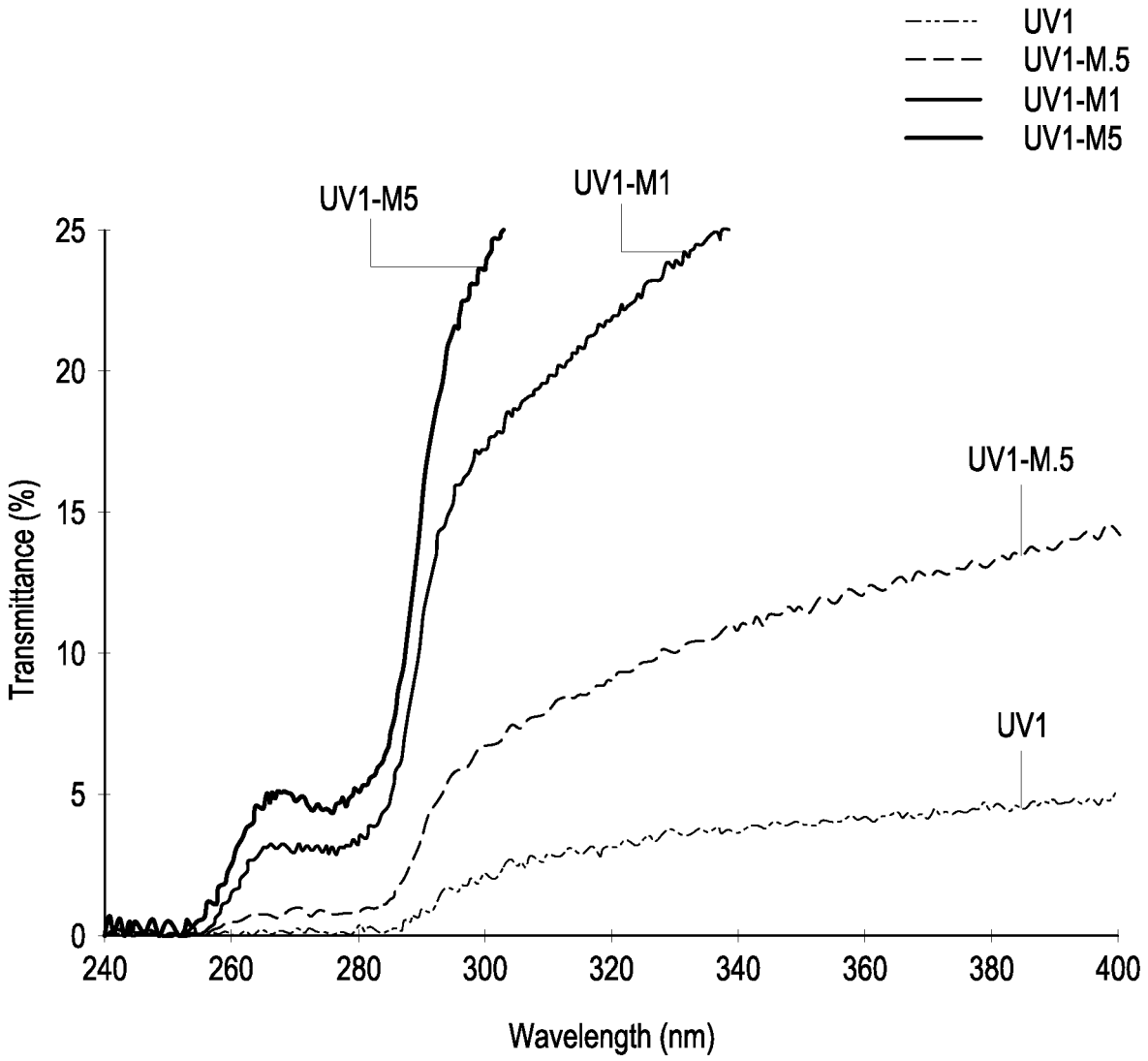
FIG. 2 is a graph of transmittance for certain Samples tested as set forth in Example 3.

Visual observation of the samples showed better clarity for sample UV2 and for samples having the hard segment inhibitor added while other samples are hazy. Further, transmittance test data shows improved transmittance for samples including the hard segment inhibitor. As shown in FIG. 2 and Table 3, UV1 with added Merpol™ A hard segment inhibitor shows significantly improved transmittance and wavelengths less than 290 nm. Note that samples UV1-M1.5 and UV1-M2 showed similar transmittance as sample UV1-M1.

TABLE 3

| Transmittance @ | UV1 | UV1-M.5 | UV1-M1 | UV1-M5 |
|---|---|---|---|---|
| 250 nm | 0 | 0 | 0.08 | 0.51 |
| 260 nm | 0 | 0.48 | 1.63 | 2.83 |
| 270 nm | 0.1 | 0.74 | 2.96 | 4.74 |
| 280 nm | 0.33 | 0.91 | 3.57 | 5.17 |
| 290 nm | 0.71 | 3.61 | 11.25 | 15.66 |
| 300 nm | 2.08 | 6.79 | 17.28 | 24.08 |

Example 3. One Step Polymerization

The catalyst, XP2716, and TMP are added to mixing cup and heated to 80° C. until the TMP is melted. The mixture is then vortex mixed and degassed. To the reaction mixture H12MDI is added and then vortex mixed. The reaction mixture is degassed again before adding to the mold. The samples are then heated in the mold in oven to 80° C. for 8 hours followed at an additional 4 hours of heating at 110° C. The composition of the Samples is shown in Table 4. The samples were characterized as discussed above with results shown in Table 5.

TABLE 4

| Sample | Wt % $H_{12}$ MDI | Wt % XP2716 | Wt % TMP | Wt % Merpol A Hard Segment Inhibitor |
|---|---|---|---|---|
| UV6 | 51.2 | 36.9 | 11.9 | — |
| UV5 | 44.5 | 46.2 | 9.3 | — |
| UV7 | 41.9 | 50.4 | 7.7 | — |
| UV5-M5 | 44.5 | 46.2 | 9.3 | 5 |
| UV7-M5 | 41.9 | 50.4 | 7.7 | 5 |

TABLE 5

| Sample | Hardness, Shore D 2 sec | G' @ 30° C., MPa | Median Elongation, % | Median Modulus, psi/MPa | Toughness psi/MPa |
|---|---|---|---|---|---|
| UV6 | 81.5 | 711 | 11 | 148367/1020 | 776/5.4 |
| UV5 | 75.1 | 394.1 | 50 | 91429/630 | 2255/15.5 |
| UV7 | 68.2 | 263.5 | 35 | 61094/421 | 1018/7.0 |
| UV5-M5 | 74.1 | 336.8 | 129 | 82627/570 | 4986/34.4 |
| UV7-M5 | 68.2 | 152.2 | 250 | 49552/342 | 7054/48.6 |

Figure 3:
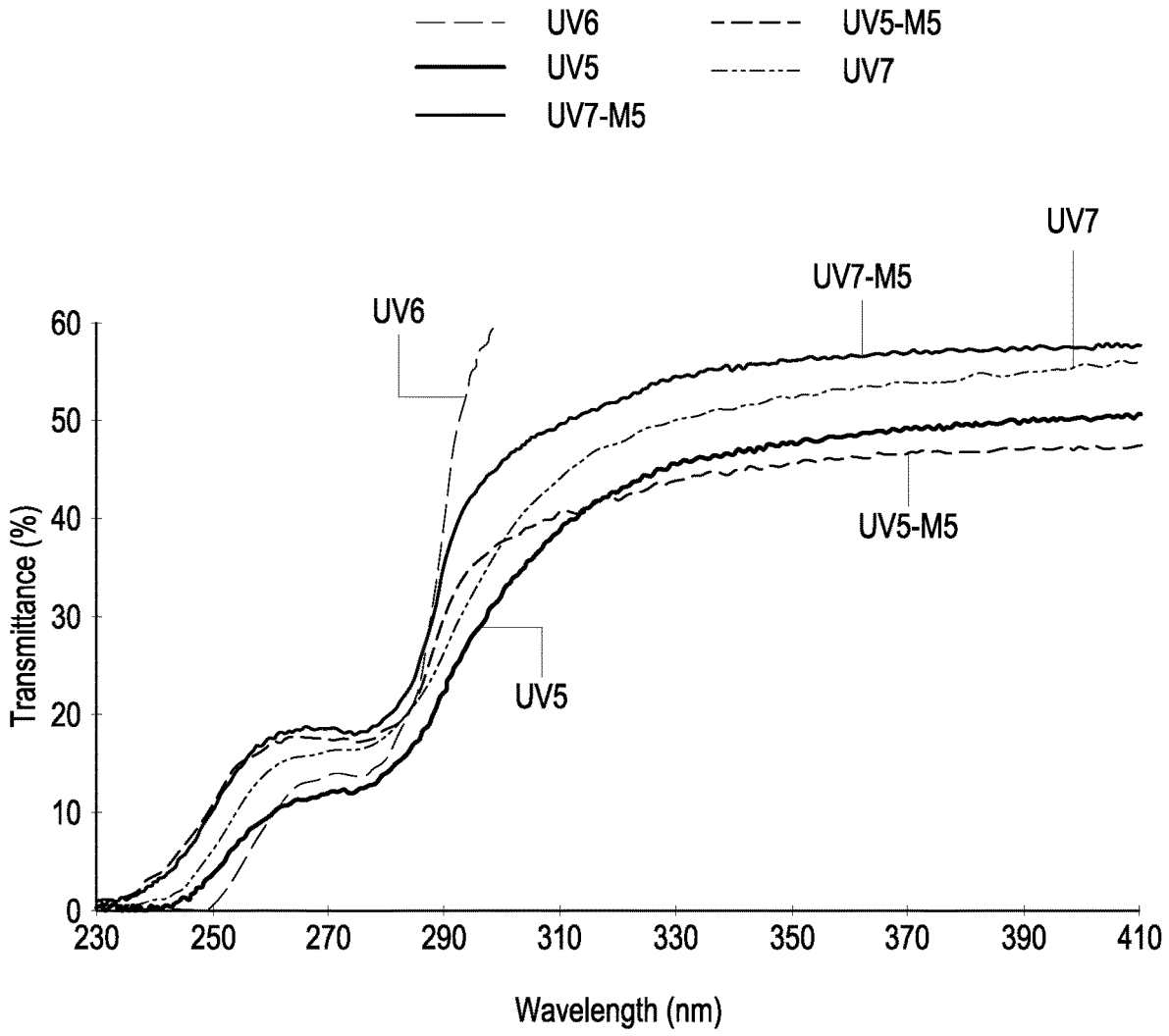
FIG. 3 a graph of transmittance for certain Samples made and tested as set forth in Example 4.

The transmittance is shown in FIG. 3 and Table 6 illustrating that the addition of Merpol™ A hard segment inhibitor improves the transmittance at wavelengths of 250 nm and even lower wavelengths.

TABLE 6

| Transmittance @ | UV6 | UV5 | UV5-M5 | UV7 | UV7-M5 |
|---|---|---|---|---|---|
| 240 nm | 0.06 | 0.09 | 3.6 | 0.76 | 3.33 |
| 250 nm | 0.53 | 4.09 | 10.98 | 6.28 | 10.27 |
| 260 nm | 9.91 | 10.07 | 17.05 | 14.26 | 17.32 |
| 270 nm | 14.03 | 12.18 | 17.71 | 16.35 | 18.41 |
| 280 nm | 16.14 | 14.21 | 18.51 | 18.31 | 19.82 |
| 290 nm | 40.55 | 22.49 | 31.04 | 26.87 | 35.72 |
| 300 nm | 60.33 | 32.67 | 37.7 | 37.86 | 46.07 |

This disclosure further encompasses the following aspects.

Aspect 1: A polishing pad useful in chemical mechanical polishing comprising a polishing portion having a top polishing surface and comprising a polishing material an opening through the polishing pad, and a transparent window within the opening in the polishing pad, the transparent window being secured to the polishing pad wherein the window comprises a polyurethane composition formed by reacting, in the presence of a hard segment inhibitor, a polymeric polyol, a polyisocyanate, and a curing agent comprising three or more hydroxyl groups wherein the polyurethane composition is free of carbon-carbon double bonds, carbon-carbon triple bonds or both.

Aspect 2: The polishing pad of Aspect 1 where in the polymeric polyol is a polymeric diol that is free of carbon-carbon double bonds, carbon-carbon triple bonds or both and has a number average molecular weight in the range of 300 to 4000.

Aspect 3: The polishing pad of Aspect 1 where in the polymeric polyol is a polyalkylene glycol having the formula HO—[R—O]$_n$—H) where R is an aliphatic group of 2, 3, 4, or 5 carbon atoms, R is independent in each occurrence or each occurrence of R is the same, and n is an integer of from 2, preferably from 3, more preferably from 4 up to 100, preferably up to 80, more preferably up to 60, yet more preferably up to 40, still more preferably up to 30, even more preferably up to 25, or most preferably up to 20

Aspect 4: The polishing pad of any of the previous Aspects wherein the hard segment inhibitor is an anionic or non-ionic additive soluble in liquid polyurethane that is free of carbon-carbon double bonds, carbon-carbon triple bonds or both.

Aspect 5: The polishing pad of any of the previous Aspects wherein the hard segment inhibitor is a sulfate, sulfonate or phosphate ester of a polyalkylene oxide.

Aspect 6: The polishing pad of Aspect 5 wherein the hard segment inhibitor is a phosphate ester of a polyalkylene oxide.

Aspect 7: The polishing pad of any of the previous Aspects wherein the curing agent comprises 3 or 4 hydroxyl groups, has a molecular weight in the range of 100 to 4000 and free of carbon-carbon double bonds, carbon-carbon triple bonds or both.

Aspect 8: The polishing pad of any of the previous Aspects wherein the polyisocyanate is a diisocyanate free of carbon-carbon double bonds, carbon-carbon triple bonds or both.

Aspect 9; The polishing page of any of the previous Aspects wherein the polyisocyanate is 1,4-cyclohexane diisocyanate; 4,4'-dicyclohexylmethane diisocyanate; isophorone diisocyanate; methylene bis-cyclohexyl isocyanate; or (4,4'-dicyclohexyl-methane diisocyanate).

Aspect 10: The polishing pad of any of the previous aspect wherein the polyurethane is formed by first reacting the polymeric polyol with the polyisocyanate to form a prepolymer and then reacting the prepolymer with the curing agent.

Aspect 11: The polishing pad of Aspect 8 wherein the hard segment inhibitor is present when reacting the polymeric polyol with the polyisocyanate.

Aspect 12: The polishing pad of Aspect 8 wherein the hard segment inhibitor is added after reacting the polymeric polyol with the polyisocyanate and is present when reacting with the curing agent.

Aspect 13: The polishing pad of any one of Aspects 10-12 wherein the polymeric polyol is a polymeric diol and the polyisocyanate is a diisocyanate and the mole ratio of diol:diisocyanate is from 1:1 to 1:1.2, preferably to 1:1.1.

Aspect 14: The polishing pad of any one of Aspects 10-12 wherein the weight percent of isocyanate groups on the prepolymer based on total weight of the prepolymer is from 5 up to 15, preferably up to 10%.

Aspect 15: The polishing pad of any one of Aspects 1-9 wherein the polymeric polyol, the polyisocyanate and the curing agent are reacted in one step in the presence of the hard segment inhibitor.

Aspect 16: The polishing pad of Aspect 15 wherein the polymeric polyol is a polycarbonate diol.

Aspect 17: The polishing pad of Aspects 15 or 16 wherein an amount of polymeric polyol and curing agent together is from 30, preferably from 35, more preferably from 40 up to 70, preferably up to 60, more preferably up to 55 weight percent based on total weight of polymeric polyol, polyisocyanate and curing agent.

Aspect 18: The polishing pad of any of Aspects 15-17 wherein the polymeric polyol is a diol and the polyisocyanate is a diisocyanate and the mole ratio of diisocyanate to polymer diol is from 1.5:1, preferably from 1.7:1, more preferably from 2:1 up to 3.5:1, preferably up to 2.5:1.

Aspect 19: The polishing pad of any one of Aspects wherein a catalyst is used in forming the polyurethane.

Aspect 20: The polishing pad of Aspect 19 wherein the catalyst is free of carbon-carbon double bonds, carbon-carbon triple bonds or both.

Aspect 21: The polishing pad of Aspect 19 wherein the catalyst is a tin containing catalyst in an amount of from 0.00001 to 0.1 wt. %, an aliphatic amine catalyst in an amount of from 0.01 to 1 wt. %, or a bismuth containing catalyst in an amount of from 0.00001 to 0.1 wt. %, all weight percents based on the total solids weight of the reaction mixture.

Aspect 22: The polishing pad of any of the previous aspects wherein the hard segment inhibitor is present in an amount of at least 0.5, preferably at least 1 up to 10, preferably up to 7, more preferably up to 6 weight percent based on total weight of the window material.

Aspect 23: The polishing pad of any of the previous aspects wherein the window has a double pass transmittance at 250 nm of at least 1%.

Aspect 24: The polishing pad of any of aspects 1-22 wherein the window has a double pass transmittance at 280 nm, preferably at 250 nm, and more preferably at 240 nm, of at least 1% and at least one of (i) a tensile modulus in the range of 3000 to 60,000 psi (20.7 to 414 MPa) and (ii) a Shore D Hardness less than 60.

Aspect 25: A polyurethane composition formed from a polymeric polyol, a polyisocyanate, and a curing agent comprising three or more hydroxyl groups in the presence of a hard segment inhibitor wherein each of the polymeric polyol, the polyisocyanate, the curing agent and the hard segment inhibitor are free of carbon-carbon double bonds, carbon-carbon triple bonds or both.

Aspect 26; The polyurethane composition of Aspect 25 where in the polymeric polyol is a polymeric diol that is free of carbon-carbon double bonds, carbon-carbon triple bonds or both, and has a number average molecular weight in the range of 300 to 4000.

Aspect 27: The polyurethane composition of Aspect 25 where in the polymeric polyol is a polyalkylene glycol having the formula HO—[R—O]$_n$—H) where R is an aliphatic group of 2, 3, 4, or 5 carbon atoms, R is independent in each occurrence or each occurrence of R is the same, and n is an integer of from 2, preferably from 3, more preferably from 4 up to 100, preferably up to 80, more preferably up to 60, yet more preferably up to 40, still more preferably up to 30, even more preferably up to 25, or most preferably up to 20.

Aspect 28: The polyurethane composition of any of Aspects 25-27 wherein the hard segment inhibitor is an anionic or non-ionic additive soluble in liquid polyurethane that is free of carbon-carbon double bonds, carbon-carbon triple bonds or both.

Aspect 29: The polyurethane composition of any of Aspects 25-28 wherein the hard segment inhibitor is a sulfate, sulfonate or phosphate ester of a polyalkylene oxide.

Aspect 30: The polyurethane composition of any of Aspects 25-28 wherein the hard segment inhibitor is a phosphate ester of a polyalkylene oxide.

Aspect 31: The polyurethane composition of any of Aspects 25-30 wherein the curing agent comprises 3 or 4 hydroxyl groups, has a molecular weight in the range of 100 to 4000 and free of carbon-carbon double bonds, carbon-carbon triple bonds or both.

Aspect 32: The polyurethane composition of any of Aspects 25-31 wherein the polyisocyanate is a diisocyanate free of carbon-carbon double bonds, carbon-carbon triple bonds or both.

Aspect 33: The polyurethane composition of any of Aspects 25-32 wherein the polyisocyanate is 4,4-cyclohexane diisocyanate; 4,4'-dicyclohexylmethane diisocyanate; isophorone diisocyanate; methylene bis-cyclohexyl isocyanate; or (4,4'-dicyclohexyl-methane diisocyanate).

Aspect 34: The polyurethane composition of any of Aspects 25-33 wherein the polyurethane is formed by first reacting the polymeric polyol with the polyisocyanate to form a prepolymer and then reacting the prepolymer with the curing agent.

Aspect 35: The polyurethane composition of Aspect 34 wherein the hard segment inhibitor is present when reacting the polymeric polyol with the polyisocyanate.

Aspect 36: The polyurethane composition of Aspect 34 wherein the hard segment inhibitor is added after reacting the polymeric polyol with the polyisocyanate and is present when reacting with the curing agent.

Aspect 37: The polyurethane composition of any one of Aspects 34-36 wherein the polymeric polyol is a polymeric diol and the polyisocyanate is a diisocyanate and the mole ratio of diol:diisocyanate is from 1:1 to 1:1.2, preferably to 1:1.1.

Aspect 38: The polyurethane composition of any one of Aspects 34-36 wherein the weight percent of isocyanate groups on the prepolymer based on total weight of the prepolymer is from 5 up to 15, preferably up to 10%.

Aspect 39: The polyurethane composition of any of Aspects 25-33 wherein the polymeric polyol, the polyisocyanate and the curing agent are reacted in one step in the presence of the hard segment inhibitor.

Aspect 40: The polyurethane composition of Aspect 39 wherein the polymeric polyol is a polycarbonate diol.

Aspect 41: The polyurethane composition of Aspect 39 or 40 wherein an amount of polymeric polyol and curing agent together is from 30, preferably from 35, more preferably from 40 up to 70, preferably up to 60, more preferably up to 55 weight percent based on total weight of polymeric polyol, polyisocyanate and curing agent.

Aspect 42: The polyurethane composition of any of Aspects 39-41 wherein the polymeric polyol is a diol and the polyisocyanate is a diisocyanate and the mole ratio of diisocyanate to polymer diol is from 1.5:1, preferably from 1.7:1, more preferably from 2:1 up to 3.5:1, preferably up to 2.5:1.

Aspect 43: The polyurethane composition of any one of Aspects 25-42 wherein a catalyst is used in forming the polyurethane.

Aspect 44: The polyurethane composition of Aspect 43 wherein the catalyst is free of carbon-carbon double bonds, carbon-carbon triple bonds or both.

Aspect 45: The polyurethane composition of Aspect 43 wherein the catalyst is a tin containing catalyst in an amount of from 0.00001 to 0.1 wt. %, an aliphatic amine catalyst in an amount of from 0.01 to 1 wt. %, or a bismuth containing catalyst in an amount of from 0.00001 to 0.1 wt. %, all weight percents based on the total solids weight of the reaction mixture.

Aspect 45: The polyurethane composition of any of aspects 25-44 wherein the hard segment inhibitor is present in an amount of at least 0.5, preferably at least 1 up to 10, preferably up to 7, more preferably up to 6 weight percent based on total weight of the window material.

Aspect 46: A polishing pad useful in chemical mechanical polishing comprising a polishing portion having a top polishing surface and comprising a polishing material an opening through the polishing pad, and a transparent window within the opening in the polishing pad, the transparent window being secured to the polishing pad wherein the polishing portion comprises a polyurethane and the window comprises a polyurethane and wherein the window is characterized by a double pass transmittance at 250 nm of at least 1%, preferably at least 4%, yet more preferably at least 10% and preferably a double pass transmittance at 240 nm of at least 0.75%.

Aspect 47: The polishing pad of Aspect 46 wherein the window is characterized by a Shore D Hardness of no greater than 75 and a modulus of less than 100,000 psi (689 MPa), preferably less than 70,000 psi (483 MPa).

Aspect 48: A polishing pad useful in chemical mechanical polishing comprising a polishing portion having a top polishing surface and comprising a polishing material an opening through the polishing pad, and a transparent window within the opening in the polishing pad, the transparent window being secured to the polishing pad wherein the polishing portion comprises a polyurethane and wherein the window has a double pass transmittance at 280 nm of at least 1% and at least one of (i) a tensile modulus according to ASTM D412-06a (2013) in the range of 3000 to 60,000 psi (20.7 to 414 MPa) and (ii) a Shore D Hardness less than 60.

The compositions, methods, and articles can alternatively comprise, consist of, or consist essentially of, any appropriate materials, steps, or components herein disclosed. The compositions, methods, and articles can additionally, or alternatively, be formulated to be devoid, or substantially free, of any materials (or species), steps, or components, that are otherwise not necessary to the achievement of the function or objectives of the compositions, methods, and articles.

All ranges disclosed herein are inclusive of the endpoints, and the endpoints are independently combinable with each other (e.g., ranges of "up to 25 wt. %, or, more specifically, 5 wt. % to 20 wt. %", is inclusive of the endpoints and all intermediate values of the ranges of "5 wt. % to 25 wt. %," etc.). Moreover, stated upper and lower limits can be combined to form ranges (e.g. "at least 1 or at least 2 weight percent" and "up to 10 or 5 weight percent" can be combined as the ranges "1 to 10 weight percent", or "1 to 5 weight percent" or "2 to 10 weight percent" or "2 to 5 weight percent"). "Combinations" is inclusive of blends, mixtures, alloys, reaction products, and the like. The terms "first," "second," and the like, do not denote any order, quantity, or importance, but rather are used to distinguish one element from another. The terms "a" and "an" and "the" do not denote a limitation of quantity and are to be construed to cover both the singular and the plural, unless otherwise indicated herein or clearly contradicted by context. Reference throughout the specification to "some embodiments", "an embodiment", and so forth, means that a particular element described in connection with the embodiment is included in at least one embodiment described herein, and may or may not be present in other embodiments. In addition, it is to be understood that the described elements may be combined in any suitable manner in the various embodiments. A "combination thereof" is open and includes any combination comprising at least one of the listed components or properties optionally together with a like or equivalent component or property not listed.

Unless specified to the contrary herein, all test standards are the most recent standard in effect as of the filing date of this application, or, if priority is claimed, the filing date of the earliest priority application in which the test standard appears.

What is claimed is:

1. A polishing pad useful in chemical mechanical polishing comprising a polishing portion having a top polishing surface and a polishing material, an opening through the polishing pad, and a transparent window within the opening in the polishing pad, the transparent window being secured to the polishing pad wherein the window comprises a polyurethane composition formed by reacting a polymeric polyol, a polyisocyanate, and a curing agent comprising three or more hydroxyl groups forming hard segments, the reacting being in the presence of a hard segment inhibitor for reducing size of hard segment domains wherein the hard segment inhibitor is a sulfate, sulfonate or phosphate ester of a polyalkylene oxide and wherein the polyurethane composition is an amorphous mixture of hard segments in a soft segments matrix and the polyurethane composition is free of carbon-carbon double bonds and wherein the transparent window has a Shore D Hardness no greater than 75.

2. The polishing pad of claim 1 where in the polymeric polyol is a polymeric diol that is free of carbon-carbon double bonds and has a number average molecular weight in the range of 300 to 4000.

3. The polishing pad of claim 1 wherein the hard segment inhibitor is an anionic or non-ionic additive that is soluble in liquid polyurethane that is free of carbon-carbon double bonds.

4. The polishing pad of claim 1 wherein the hard segment inhibitor is a phosphate ester of a polyalkylene oxide.

5. The polishing pad of claim 1 wherein the curing agent comprises 3 or 4 hydroxyl groups, has a molecular weight in the range of 100 to 4000 and is free of carbon-carbon double bonds.

6. The polishing pad of claim 1 wherein the polyisocyanate is a diisocyanate free of carbon-carbon double bonds.

7. The polishing pad of claim 1 wherein the window has a double pass transmittance at 250 nm of at least 1%.

8. The polishing pad of claim 1 wherein the window has a double pass transmittance at 280 nm of at least 1% and at least one of (i) a tensile modulus in the range of 3000 to 60,000 psi (20.7 to 414 MPa) and (ii) a Shore D Hardness less than 60.

9. The polishing pad of claim 1 wherein either the polymeric diol is first reacted with the polyisocyanate to form a prepolymer and then the prepolymer is reacted with the curing agent, or the polymeric diol, the polyisocyanate and the curing agent are all combined and then reacted.

10. The polishing pad of claim 1 wherein the window is characterized by a double pass transmittance at 250 nm of at least 1%, a Shore D Hardness of no greater than 60 and a tensile modulus of 3,000 psi (20.7 MPa) to 70,000 psi (483 MPa).

* * * * *